US006736493B2

(12) United States Patent
Sekiguchi

(10) Patent No.: US 6,736,493 B2
(45) Date of Patent: May 18, 2004

(54) INK-JET PRINT HEAD

(75) Inventor: Yasuhiro Sekiguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 43 days.

(21) Appl. No.: 10/131,038

(22) Filed: Apr. 25, 2002

(65) Prior Publication Data

US 2002/0163565 A1 Nov. 7, 2002

(30) Foreign Application Priority Data

May 1, 2001 (JP) ..... 2001-134387

(51) Int. Cl.[7] ..... B41J 2/045
(52) U.S. Cl. ..... 347/71
(58) Field of Search ..... 347/68–72

(56) References Cited

U.S. PATENT DOCUMENTS 5,402,159 A 3/1995 Takahashi et al.
5,956,059 A * 9/1999 Usui ..... 347/71
6,033,058 A * 3/2000 Usui et al. ..... 347/71
6,328,435 B1 * 12/2001 Ono et al. ..... 347/70
6,557,986 B2 * 5/2003 Watanabe et al. ..... 347/70
2002/0154197 A1 * 10/2002 Sakamoto et al. ..... 347/68

* cited by examiner

*Primary Examiner*—Stephen D. Meier
*Assistant Examiner*—An H. Do
(74) *Attorney, Agent, or Firm*—Oliff & Berridge, PLC

(57) ABSTRACT

A piezoelectric ink-jet print head is structured such that a plurality of plates are laminated to each other. The piezoelectric ink-jet print head includes an ink chamber that stores ink, a pressure chamber that is to be supplied with the ink from the ink chamber, a nozzle that communicates with the pressure chamber, an actuator that causes pressure change in the pressure chamber, and a narrowed portion that is provided between the ink chamber and the pressure chamber and is narrower than a cross-sectional area of the pressure chamber. In the piezoelectric ink-jet print head, the narrowed portion, the pressure chamber and the nozzle form an ink passage. A percentage of an ink-flow resistance of the narrowed portion is between 50% and 70% with respect to an ink-flow resistance of the ink passage, and a percentage of a cross-sectional area of the narrowed portion with respect to the cross-sectional area of the pressure chamber is between 10% and 20%.

48 Claims, 7 Drawing Sheets

| | | PERCENTAGE OF INK-FLOW RESISTANCE OF NARROWED PORTION WITH RESPECT TO INK PASSAGE (%) | | | | |
|---|---|---|---|---|---|---|
| | | 40 | 50 | 60 | 70 | 80 |
| PERCENTAGE OF CROSS-SECTIONAL AREA OF NARROWED PORTION WITH RESPECT TO CROSS-SECTIONAL AREA OF PRESSURE CHAMBER (%) | 5 | △ | △ | × | × | × |
| | 10 | △ | ○ | ○ | ○ | × |
| | 15 | × | ○ | ○ | ○ | × |
| | 20 | × | ○ | ○ | ○ | △ |
| | 25 | × | × | × | △ | △ |
| | 30 | × | × | × | × | △ |

○ ···INK STABLY EJECTED
△ ···INK STABLY EJECTED DEPENDING ON CONDITIONS
× ···INK UNSTABLY EJECTED

FIG.3

| | | PERCENTAGE OF INK-FLOW RESISTANCE OF NARROWED PORTION WITH RESPECT TO INK PASSAGE (%) | | | | |
|---|---|---|---|---|---|---|
| | | 40 | 50 | 60 | 70 | 80 |
| PERCENTAGE OF CROSS-SECTIONAL AREA OF NARROWED PORTION WITH RESPECT TO CROSS-SECTIONAL AREA OF PRESSURE CHAMBER (%) | 5 | △ | △ | × | × | × |
| | 10 | △ | ○ | ○ | ○ | × |
| | 15 | × | ○ | ○ | ○ | × |
| | 20 | × | ○ | ○ | ○ | △ |
| | 25 | × | × | × | △ | △ |
| | 30 | × | × | × | × | △ |

○ ···INK STABLY EJECTED

△ ···INK STABLY EJECTED DEPENDING ON CONDITIONS

× ···INK UNSTABLY EJECTED

INK-JET PRINT HEAD

BACKGROUND OF THE INVENTION

1. Field of Invention

The invention relates to a piezoelectric ink-jet print head.

2. Description of Related Art

A piezoelectric ink-jet print head wherein a piezoelectric element is disposed adjacent to pressure chambers, has been known as an ink-jet print head for an ink-jet printer.

In the piezoelectric ink-jet print head, a predetermined driving pulse is applied to the piezoelectric element to change an internal volume of the pressure chambers. As a result, ink droplets are ejected from nozzles, and thus printing is performed on a recording sheet.

Therefore, in the piezoelectric ink-jet print head, it is necessary to prevent excessive ink droplets from being ejected from the nozzles, by reducing the pressure in the pressure chambers after ink droplets are ejected.

Conventionally, in an ink passage provided in the piezoelectric ink-jet print head, a percentage of an ink-flow resistance of the pressure chambers or the nozzles is set to higher than that of other portions constituting the ink passage. By doing so, the pressure in the pressure chambers after ink ejection is reduced and ink droplets are stably ejected.

However, in the conventional method, in order to obtain enough ink-flow resistance in the pressure chambers, a length of each of the pressure chambers are sufficiently elongated, or a cross-sectional area of each of the pressure chambers needs to be extremely small. However, this structure causes the following problems.

The increase in length of the pressure chambers causes the piezoelectric ink-jet print head to become large in size. Further, a frequency of pressure change in the pressure chambers becomes long, so that the conventional piezoelectric ink-jet print head is not suited to perform high-speed printing.

The decrease in size of the cross-sectional area of the pressure chambers requires a strong pressure to be applied to the pressure chambers to obtain a predetermined amount of ink droplets. This causes an extremely large negative pressure in the pressure chambers, resulting in a loss of stability in the ink ejection.

When the percentage of the ink-flow resistance in the nozzles is high, an amount of ejected ink droplets is small for the pressure generated. As a result, an ink ejection speed is increased too much, so that meniscuses become easy to break.

SUMMARY OF THE INVENTION

The invention provides a piezoelectric ink-jet print head that is suited for high-speed printing and can eject ink droplets at a proper speed without loosing stability in the ink ejection.

According to one aspect of the invention, a piezoelectric ink-jet print head is structured such that a plurality of plates are laminated onto each other. The piezoelectric ink-jet print head includes a plurality of plates laminated onto each other, an ink chamber that stores ink, a pressure chamber that is to be supplied with the ink from the ink chamber, a nozzle that communicates with the pressure chamber, an actuator that causes pressure change in the pressure chamber, and a narrowed portion that is provided between the ink chamber and the pressure chamber and is narrower than a cross-sectional area of the pressure chamber. In the piezoelectric ink-jet print head, the narrowed portion, the pressure chamber and the nozzle form an ink passage. A percentage of an ink-flow resistance of the narrowed portion is 50% or more with respect to an ink-flow resistance of the ink passage.

With this structure, enough ink-flow resistance can be obtained in the narrowed portion without elongating the pressure chamber in length more than necessary. Therefore, high-speed printing can be achieved by using the piezoelectric ink-jet print head. It is also unnecessary to make the cross-sectional area of the pressure chamber extremely small, so that printing can be performed with ink ejection efficiency.

BRIEF DESCRIPTION OF THE DRAWINGS

Exemplary embodiments of the invention will be described in detail with reference to the following figures wherein:

FIG. 3 is a table showing a relationship between a percentage of an ink-flow resistance in the narrowed portion with respect to an ink passage and a percentage of a cross-sectional area of the narrowed portion with respect to a cross-sectional area of a pressure chamber;

DETAILED DESCRIPTION OF PREFERRED EMBODIMENTS

Exemplary embodiments of the invention will be described with reference to the accompanying drawings. Explanations will be given by which the invention is applied.

Figure 1:
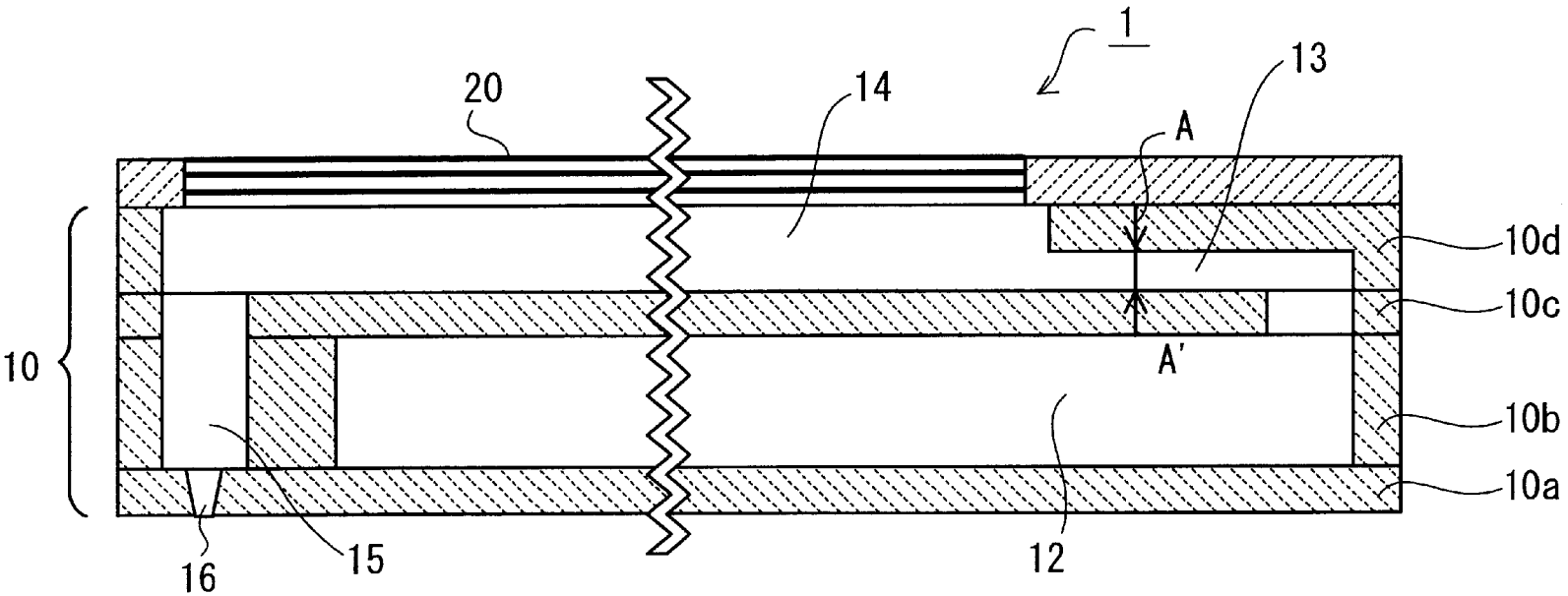
FIG. 1 is a sectional view of a piezoelectric ink-jet print head according to a first embodiment of the invention.

FIG. 1 is a schematic sectional view showing a piezoelectric ink-jet print head 1 of a first embodiment of the invention.

As shown in FIG. 1, the piezoelectric ink-jet print head 1 includes a cavity plate 10 and a piezoelectric actuator 20.

The cavity plate 10 includes four thin plates 10*a* to 10*d*, which are laminated onto each other. Each of the thin plates 10*a* to 10*d* is formed with openings and recesses by pressing or etching. Those openings and recesses are communicated with each other by laminating the plates 10*a* to 10*d*, to form an ink-flow path. A common ink chamber 12, a plurality of pressure chambers 14, narrowed portions 13, through-holes 15, and a plurality of nozzles 16 constitutes the ink-flow path. The plurality of the pressure chambers 14 communicate with the common ink chamber 12 via the narrowed portion 13. The plurality of the nozzles 16 connect the respective pressure chambers 14 via the through-holes 15.

The cavity plate 10 includes four thin plates 10*a* to 10*d*, which are adhesively bonded to each other. In this embodiment, each plate 10*a* to 10*d* is made of steel alloyed with 42% nickel and has a thickness of 50 μm–150 μm. Each plate 10*a* to 10*d* is not limited to metal and may be made of other material such as resin or ceramics.

The piezoelectric actuator 20 has the same structure as that disclosed in U.S. Pat. No. 5,402,159, wherein piezoelectric sheets and driving electrodes corresponding to the pressure chambers 14 are laminated onto each other. Portions of the piezoelectric sheet corresponding to the respective pressure chambers 14 individually deform.

When a driving pulse is applied by a driving device to a driving electrode on the piezoelectric actuator 20, the piezoelectric effects of the piezoelectric sheets develop deformation in the lamination direction. Therefore, the internal volume of the pressure chamber 14 corresponding to the driving electrode is reduced by the pressure produced due to the deformation. As a result, ink in the pressure chamber 14 is ejected from the respective nozzle 16, and thus printing is performed.

The ink-flow path is made up of an ink supply port (not shown), the common ink chamber 12, the narrowed portion 13, the pressure chamber 14, the through-hole 15, and the nozzle 16, in this order, from the upstream. Ink is supplied from the ink supply port to the common ink chamber 12 connecting the ink supply port. Then, the ink is supplied to the pressure chamber 14 via the narrowed portion 13. Finally, the ink is supplied from the pressure chamber 14 to the nozzle 16 via the through-hole 15, and thus the ink is ejected from the nozzle 16.

In the ink-flow path, the narrowed portion 13, the pressure chamber 14 and the nozzle 16 form an ink passage. A proportion of each ink-flow resistance of the nozzle 16, the pressure chamber 14 and the narrowed portion 13 in each ink passage is determined as described below.

Nozzle 16: pressure chamber 14: narrowed portion 13=25:15:60 In the piezoelectric ink-jet print head 1 of the embodiment, it is designed such that an ink-flow resistance of the narrowed portion 13 with respect to the ink passage is 60%.

It is designed such that a percentage of the cross-sectional area of the narrowed portion 13 is 11.8% with respect to the cross-sectional area of the pressure chamber 14.

Figure 2:
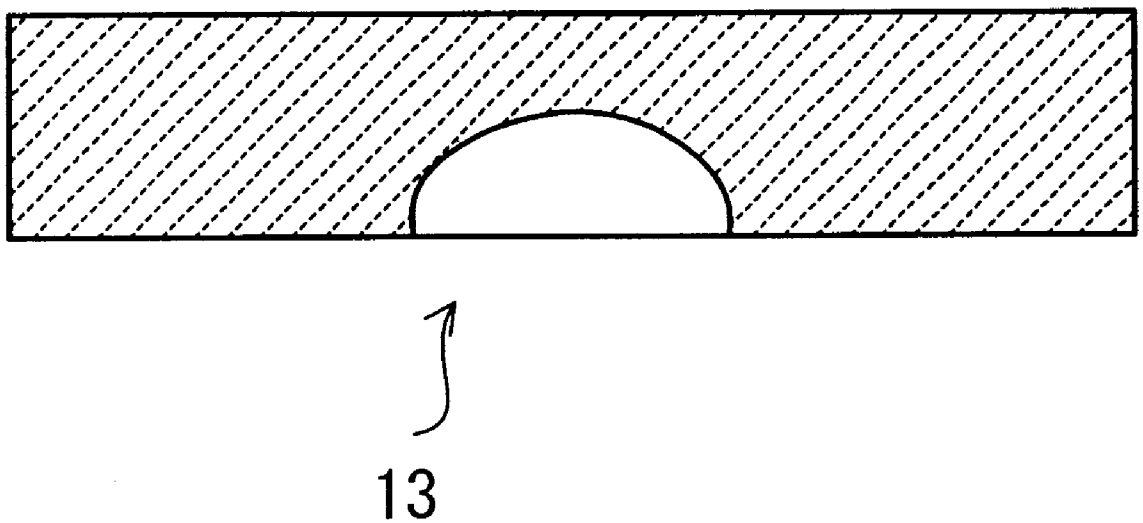
FIG. 2 is an enlarged sectional view of a narrowed portion taken along a line A-A' of FIG. 1.

More specifically, when the nozzle 16 has a diameter of 25 μm, a length of 75 μm and a tapered angle of 9 degrees and the pressure chamber 14 has a width of 250 μm, a depth of 50 μm and a length of 4000 μm, the narrowed portion 13 has a semi-elliptical shape with a width of 67 μm and a depth of 28 μm in cross section and its length is 345 μm. The cross section of the narrowed portion 13 is shown in FIG. 2.

By designing the percentage of the ink-flow resistance of the narrowed portion 13 as described above, the pressure to be generated in the pressure chamber 14 can be excellently controlled without the pressure chamber 14 elongated in length more than necessary. Further, a frequency of pressure change does not become too long, so that the piezoelectric ink-jet print head 1 is suited for high-speed printing. Ink ejection efficiency can also be improved.

By setting the cross-sectional area of the narrowed portion 13 to 11.8% with respect to the cross-sectional area of the pressure chamber 14, production yields can be improved. Further, the piezoelectric ink-jet print head 1 can be compact and high-speed printing can be achieved using the piezoelectric ink-jet print head 1.

The narrowed portions 13 are formed in the thin plate 10*d* by half-etching, so that the narrowed portions 13 can be effectively formed at a low cost.

FIG. 3 shows a relationship between a percentage of the ink-flow resistance in the narrowed portion 13 with respect to the ink passage and a percentage of the cross-sectional area of the narrowed portion 13 with respect to the cross-sectional area of the pressure chamber 14. The details of the relationship will be described below.

In all cases described below, the pressure chamber 14 has a width of 250 μm, a depth of 50 μm and a length of 4000 μm.

When a narrowed portion 13 has a semi-elliptical shape in cross-section with a width of 72 μm, a depth of 30 μm and a length 457 μm, the percentage of the ink-flow resistance of the narrowed portion 13 with respect to the ink passage is 60.1% and the percentage of the cross-sectional area of the narrowed portion 13 with respect to the cross-sectional area of the pressure chamber 14 is 13.6%. In this case, ink droplets are stably ejected from the nozzle 16.

When a narrowed portion 13 has a rectangular shape in cross-section with a width of 50 μm, a depth of 30 μm and a length of 387 μm, the percentage of the ink-flow resistance of the narrowed portion 13 with respect to the ink passage is 60.4% and the percentage of the cross-sectional area of the narrowed portion 13 with respect to the cross-sectional area of the pressure chamber 14 is 12.0%. In this case, ink droplets are stably ejected from the nozzle 16.

Further, when a narrowed portion 13 has a rectangular shape in cross-section with a width of 70 μm, a depth of 30 μm and a length of 672 μm, the percentage of the ink-flow resistance of the narrowed portion 13 with respect to the ink passage is 60.1% and the percentage of the cross-sectional area of the narrowed portion 13 with respect to the cross-sectional area of the pressure chamber 14 is 16.8%. In this case, also, ink droplets are stably ejected from the nozzle 16.

When a narrowed portion 13 has a rectangular shape in cross-section with a width of 90 μm, a depth of 30 μm and a length of 992 μm, the percentage of the ink-flow resistance of the narrowed portion 13 with respect to the ink passage is 60.1% and the percentage of the cross-sectional area of the narrowed portion 13 with respect to the cross-sectional area of the pressure chamber 14 is 21.6%. In this case, ink droplets are unstably ejected from the nozzle 16.

As can be seen from the above description, the percentage of the ink-flow resistance of the narrowed portion 13 with respect to the ink passage is preferably between 50% and 70%, and the percentage of the cross-sectional area of the narrowed portion 13 with respect to the cross-sectional area of the pressure chamber 14 is preferably between 10% and 20%.

A piezoelectric ink-jet print head 106 of a second embodiment of the invention will be described below.

Figure 4:
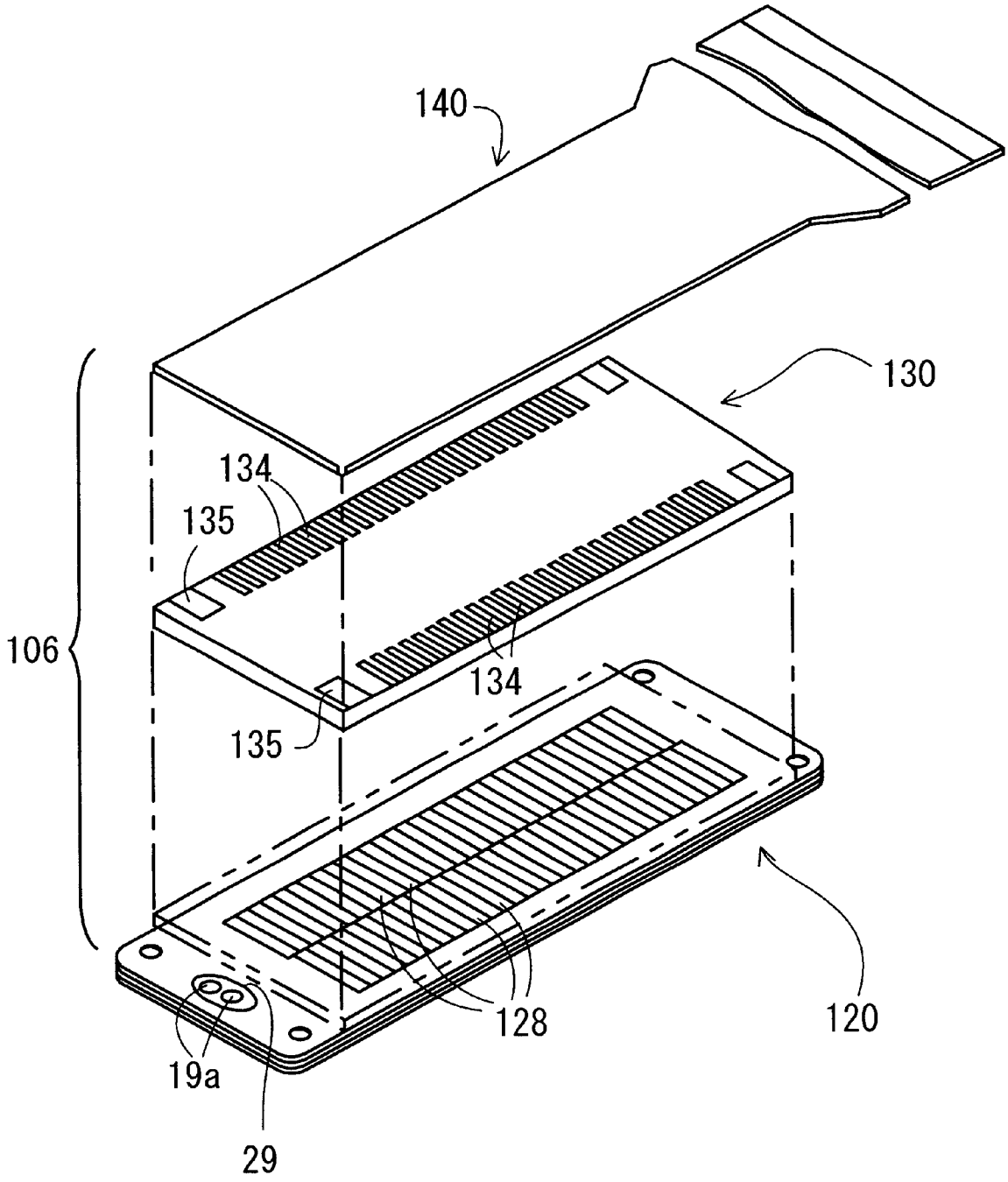
FIG. 4 is an exploded perspective view of a piezoelectric ink-jet print head according to a second embodiment of the invention.
Figure 5:
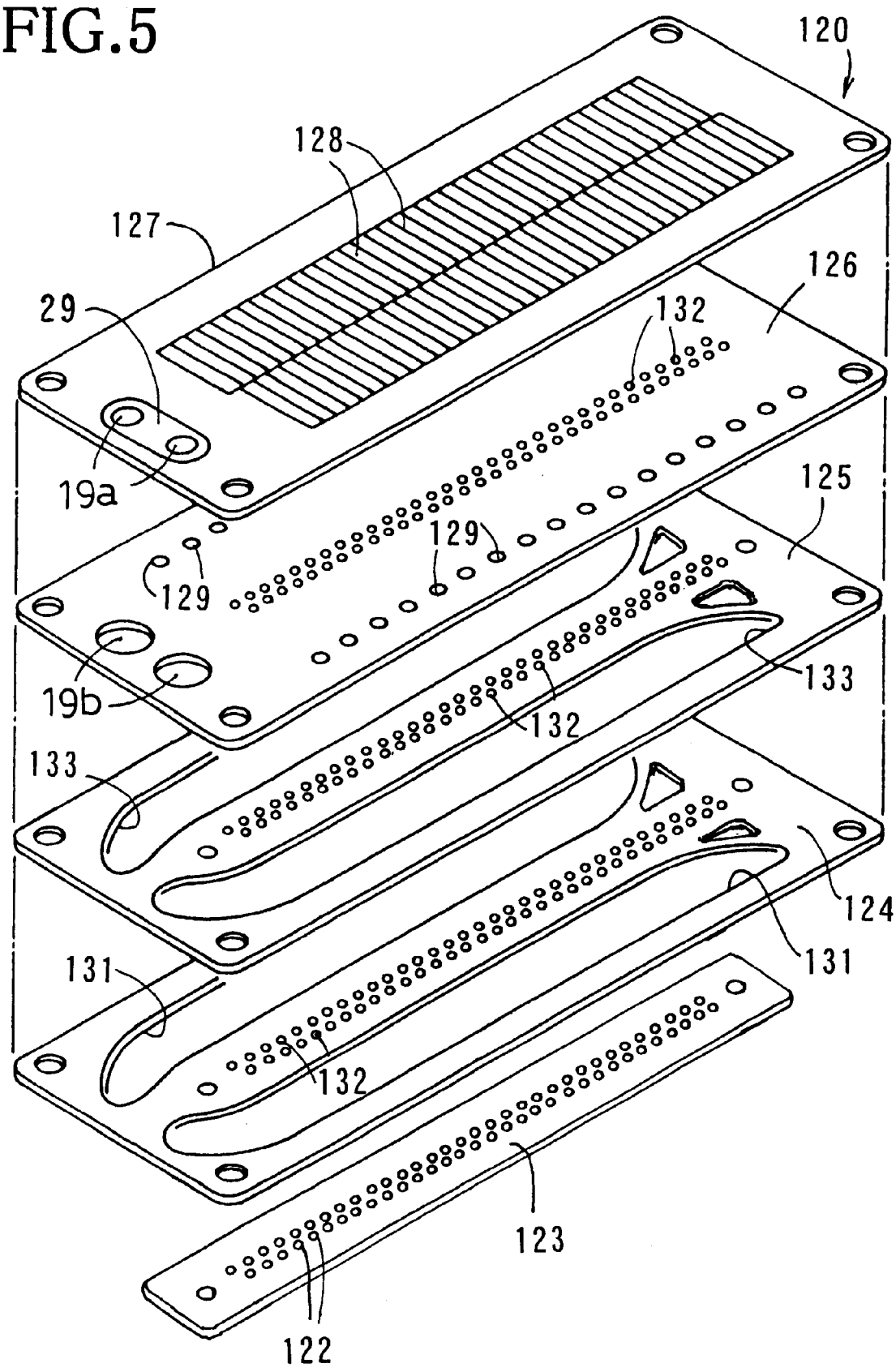
FIG. 5 is an exploded perspective view of parts of a cavity plate according to the second embodiment.
Figure 6:
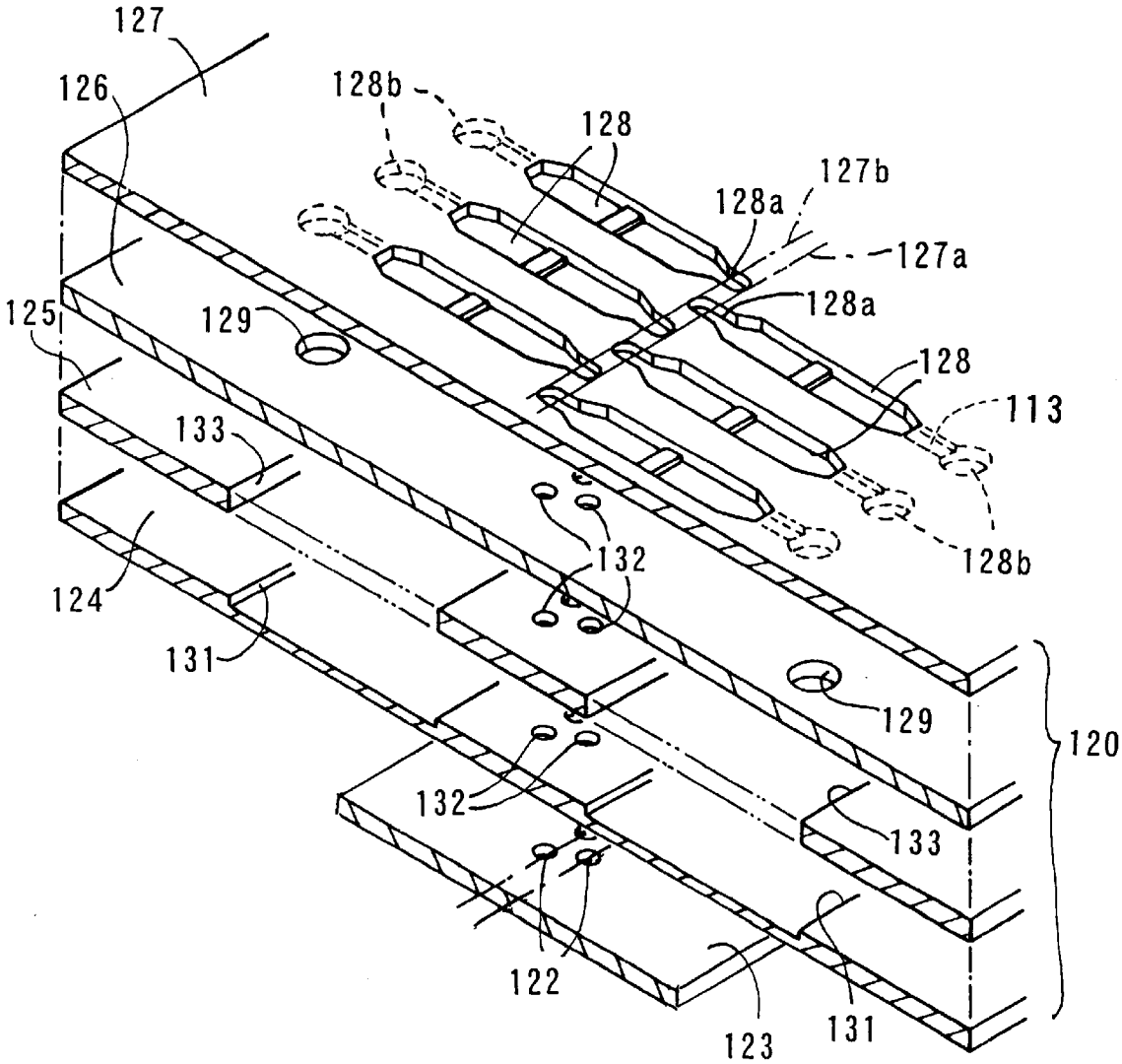
FIG. 6 is a partially enlarged perspective view of the cavity plate according to the second embodiment.

The piezoelectric ink-jet print heads 106 and the parts that make up the piezoelectric ink-jet print heads 106 will be described. As shown in FIGS. 4 to 6, the piezoelectric ink-jet print head 106 includes a multi-layered cavity plate 120, a plate-type piezoelectric actuator 130, and a flexible flat cable 140. The piezoelectric actuator 130 is adhered to the cavity plate 120 via an adhesive sheet 41 (FIG. 7), and the flexible flat cable 140 is bonded to the top of the piezoelectric actuator 130 for electrical connection with external equipment.

A filter 29 (FIGS. 4 and 5) for eliminating dust in the ink supplied from an ink cartridge (not shown) is adhesively fixed over ink supply ports 19*a* drilled on one side of the base plate 127, which is on the reverse side surface of the piezoelectric ink-jet print head 106.

As shown in FIGS. 5 and 6, the cavity plate 120 includes five thin metal plates: a nozzle plate 123, two manifold plates 124, 125, a spacer plate 126, and a base plate 127, which are adhesively bonded to each other. In this embodiment, each plate is made of steel alloyed with 42% nickel and has a thickness of 50 μm–150 μm. Each plate is not limited to be constructed of metal and may be made of other material such as resin or ceramics.

The manifold plate 124 is adhered to the nozzle plate 123. Through-holes 132 communicating with the nozzles 122 are longitudinally staggered in two rows, with a fixed pitch, on the manifold plates 124, 125 and the spacer plate 126. The manifold plates 124, 125 are formed with ink chambers 131, 133 extending along the rows of the through-holes 132. The ink chambers 131 are recessed in the manifold plate 124 (FIG. 6). The ink chambers 131, 133 in the manifold plates 124, 125 are hermetically sealed as the spacer plate 126 is laminated onto the manifold plate 125.

The base plate 127 has two rows of staggered narrow pressure chambers 128 each of which extends in a direction orthogonal to a centerline along a longitudinal direction of the base plate 127. Reference lines 127*a*, 127*b*, which are parallel to each other, are set at both sides of the centerline. Narrow end portions 128*a* of the pressure chambers 128 on the left of the centerline are disposed on the reference line 127*a*, and the narrow end portions 128*a* of the pressure chambers 128 on the right of the centerline are disposed on the reference line 127*b*. The narrow end portions 128*a* of the pressure chambers on the right and left sides of the centerline are alternately positioned. That is, alternate pressure chambers 128 extend from the narrow end portions 128*a* in direction opposite to each other.

Figure 7:
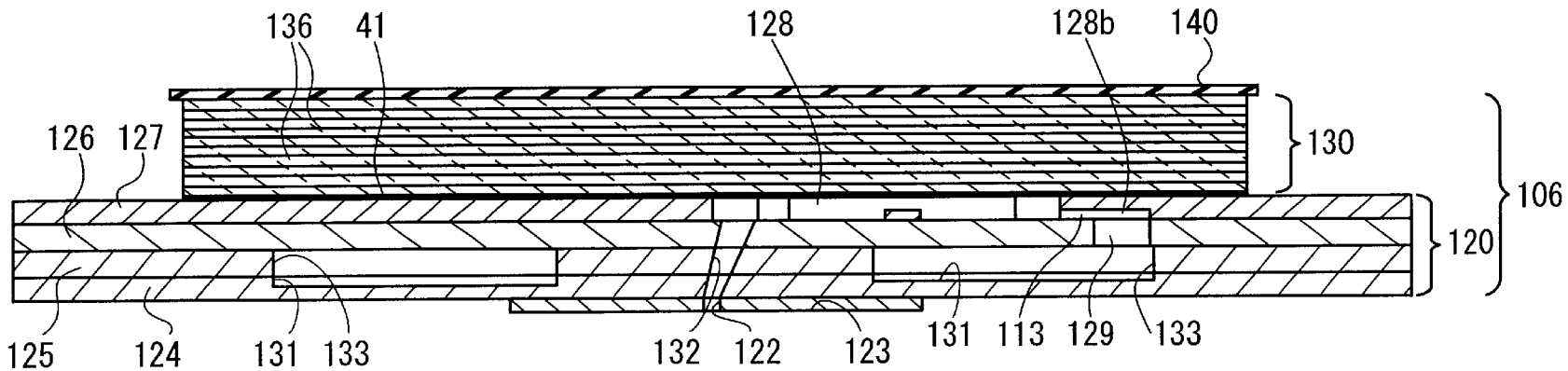
FIG. 7 is an enlarged sectional side view of the piezoelectric ink-jet print head according to the second embodiment.

The narrow end portions 128*a* of the pressure chambers 128 communicate with the staggered through-holes 132 drilled in the spacer plate 126 and the manifold plates 124, 125. Other end portions 128*b* connect to the pressure chambers 128 via narrowed portions 113 and communicate with the ink chambers 131, 133 in the manifold plates 124, 125 via ink supply holes 129 drilled on opposite sides of the spacer plate 126. As shown in FIGS. 6 and 7, the narrowed portions 113 and the other end portions 128*b* of the pressure chambers 128 are recessed on the lower surface of the base plate 127. The narrowed portions 113 has the same shape in cross-section as the narrowed portions 13 of the first embodiment as shown in FIG. 2.

By doing so, ink flows in the ink chambers 131, 133 from ink supply ports 19*a*, 19*b* drilled at an end portion of the base plate 127 and the spacer plate 126, passes from the ink chamber 133 to the ink supply holes 129, and is distributed into each of the pressure chambers 128. The ink passes from the pressure chambers 128 to the nozzles 122 via the through-holes 132. (Refer to FIG. 7.)

As shown in FIG. 7, the piezoelectric actuator 130 is structured wherein a plurality of piezoelectric sheets 136 are laminated one above the other. As in the case disclosed in U.S. Pat. No. 5,402,159, narrow electrodes (not shown) are formed with respect each of the pressure chambers 128 on upper surfaces of the lowest piezoelectric sheet 136 and the odd piezoelectric sheets 136 counted upward from the lowest one. On upper surfaces of the even piezoelectric sheets 136 counted from the lowest one, common electrodes (not shown) are formed with respect to some pressure chambers 128. Surface electrodes 134, 135 are provided on the top surface of the piezoelectric actuator 130 along the edges of the long sides. The surface electrodes 134 are electrically connected to the each of the narrow electrodes and the surface electrodes 135 are electrically connected to the common electrodes. (Refer to FIG. 4.)

The piezoelectric actuator 130 is laminated to the cavity plate 120 in such a manner that each of the narrow electrodes in the piezoelectric actuator 130 is associated with each of the pressure chambers 128 in the cavity plate 120. As the flexible flat cable 140 is overlaid on an upper surface of the piezoelectric actuator 130, various wiring patterns (not shown) in the flexible flat cable 140 are electrically connected to the surface electrodes 134, 135.

With this structure, when voltage is applied between one of the narrow electrodes and one of the common electrodes in the piezoelectric actuator 130, the piezoelectric sheet 136 sandwiched between the narrow electrode and the common electrode deforms by piezoelectric effect in a direction where the piezoelectric sheets are laminated. By this deformation, the volume of the pressure chamber 128 corresponding to the narrow electrode is reduced, causing ink stored in the pressure chamber 128 to be ejected in a droplet from the associated nozzle 122 (FIG. 7), thereby performing printing.

While the invention has been described in detail with reference to a specific embodiment thereof, it would be apparent to those skilled in the art that various changes and modifications may be made therein without departing from the spirit of the invention.

What is claimed is:

1. An ink-jet print head including a plurality of plates laminated onto each other, comprising:

an ink chamber that stores ink and is located within one of said plurality of plates;

a pressure chamber that is to be supplied with the ink from the ink chamber;

a nozzle that communicates with the pressure chamber;

an actuator that causes pressure change in the pressure chamber; and a narrowed portion that is provided between the ink chamber and the pressure chamber and is narrower than a cross-sectional area of the pressure chamber, wherein the narrowed portion, the pressure chamber and the nozzle form an ink passage, and a percentage of an ink-flow resistance of the narrowed portion is 50% or more with respect to an ink-flow resistance of the ink passage.

2. The ink-jet print head according to claim 1, wherein the percentage of the ink-flow resistance of the narrowed portion is between 50% to 70% with respect to the ink-flow resistance of the ink passage.

3. The ink-jet print head according to claim 2, wherein a cross-sectional area of the narrowed portion is 10% to 20% with respect to the cross-sectional area of the pressure chamber.

4. The ink-jet print head according to claim 1, wherein the narrowed portion is recessed in a bottom surface of a top one of said plurality of plates laminated onto each other.

5. The ink-jet print head according to claim 4, wherein the narrowed portion has a semi-elliptical shape in cross-section.

6. The ink-jet print head according to claim 4, wherein the narrowed portion has a rectangular shape in cross-section.

7. The ink-jet print head according to claim 1, wherein the nozzle is located within a bottom one of said plurality of plates.

8. The ink-jet print head according to claim 1, wherein the actuator is located above a top surface of a top one of said plurality of plates.

9. An ink-jet print head including a plurality of plates laminated onto each other, comprising:

a first ink chamber that stores ink and is located within a first one of said plurality of plates;

a second ink chamber that stores the ink, is located within a second one of said plurality of plates, and is located above said first ink chamber;

a pressure chamber that is to be supplied with the ink from the first ink chamber and the second ink chamber;

a nozzle that communicates with the pressure chamber;

an actuator that causes pressure change in the pressure chamber; and a narrowed portion that is provided between the first ink chamber and the pressure chamber and is narrower than a cross-sectional area of the pressure chamber, wherein the narrowed portion, the pressure chamber and the nozzle form an ink passage, and a percentage of an ink-flow resistance of the narrowed portion is 50% or more with respect to an ink-flow resistance of the ink passage.

10. The ink-jet print head according to claim 9, wherein the percentage of the ink-flow resistance of the narrowed portion is between 50% to 70% with respect to the ink-flow resistance of the ink passage.

11. The ink-jet print head according to claim 10, wherein a cross-sectional area of the narrowed portion is 10% to 20% with respect to the cross-sectional area of the pressure chamber.

12. The ink-jet print head according to claim 9, wherein the narrowed portion is recessed in a bottom surface of a top one of the said plurality of plates.

13. The ink-jet print head according to claim 12, wherein the narrowed portion has a semi-elliptical shape in cross-section.

14. The ink-jet print head according to claim 12, wherein the narrowed portion has a rectangular shape in cross-section.

15. The ink-jet print head according to claim 9, wherein the nozzle is located within a bottom one of said plurality of plates.

16. The ink-jet print head according to claim 9, wherein the actuator is located above a top surface of a top one of said plurality of plates.

17. The ink-jet print head according to claim 9, wherein the piezoelectric actuator includes a plurality of piezoelectric sheets.

18. The ink-jet print head according to claim 9, further comprising a flexible flat cable.

19. The ink-jet print head according to claim 9, wherein the first ink chamber is recessed in a top surface of said first one of said plurality of plates.

20. The ink-jet print head according to claim 9, wherein said pressure chamber includes a plurality of pressure chambers and said narrowed portion includes a plurality of narrowed portions.

21. The ink-jet print head according to claim 20, wherein said first one of said plurality of plates includes first through-holes longitudinally staggered in two rows.

22. The ink-jet print head according to claim 21, wherein said second one of said plurality of plates includes second through-holes longitudinally staggered in two rows and communicating with said first through-holes.

23. The ink-jet print head according to claim 22, wherein said nozzle includes a plurality of nozzles communicating with said first through-holes and said second through-holes.

24. The ink-jet print head according to claim 23, wherein a third one of said plurality of plates includes first ink supply ports.

25. The ink-jet print head according to claim 24, wherein a top one of said plurality of plates includes second ink supply ports.

26. The ink-jet print head according to claim 25, wherein each of the pressure chambers includes a narrow end portion and another end portion.

27. The ink-jet print head according to claim 26, wherein said narrow end portions communicate with said first through-holes and said second through-holes.

28. The ink-jet print head according to claim 27, wherein said pressure chambers are connected via said narrowed portions to a plurality of another end portions which communicate via said first ink chamber and said second ink chamber with said first and second ink supply ports of said third one of said plurality of plates and said top one of said plurality of plates.

29. An ink-jet print head including a base plate, spacer plate, a first manifold plate, a second manifold plate and a nozzle plate laminated onto each other, comprising:

a first ink chamber that stores ink and is located within the second manifold plate;

a second ink chamber that stores the ink and is located within the first manifold plate which is above the second manifold plate;

a pressure chamber that is to be supplied with the ink from the first ink chamber and the second ink chamber, and is located within the base plate;

a nozzle that communicates with the pressure chamber and is located within the nozzle plate which is located below the second manifold plate;

an actuator that causes pressure change in the pressure chamber; and a narrowed portion that is provided between the first ink chamber and the pressure chamber and is narrower than a cross-sectional area of the pressure chamber, wherein the narrowed portion, the pressure chamber and the nozzle form an ink passage, and a percentage of a resistance of an ink-flow resistance of the narrowed portion is 50% or more with respect to an ink-flow resistance of the ink passage.

30. The ink-jet print head according to claim 29, wherein the percentage of the ink-flow resistance of the narrowed portion is between 50% to 70% with respect to the ink-flow resistance of the ink passage.

31. The ink-jet print head according to claim 30, wherein a cross-sectional area of the narrowed portion is 10% to 20% with respect to the cross-sectional area of the pressure chamber.

32. The ink-jet print head according to claim 29, wherein the narrowed portion is recessed in a bottom surface of a base plate.

33. The ink-jet print head according to claim 32, wherein the narrowed portion has a semi-elliptical shape in cross-section.

34. The ink-jet print head according to claim 32, wherein the narrowed portion has a rectangular shape in cross-section.

35. The ink-jet print head according to claim 29, wherein the nozzle is located within a nozzle plate.

36. The ink-jet print head according to claim 29, wherein the actuator is located above a top surface of said base plate.

37. The ink-jet print head according to claim 29, wherein the piezoelectric actuator includes a plurality of piezoelectric sheets.

38. The ink-jet print head according to claim 29, further comprising a flexible flat cable.

39. The ink-jet print head according to claim 29, wherein the first ink chamber is recessed in a top surface of said second manifold plate.

40. The ink-jet print head according to claim 29, wherein said pressure chamber includes a plurality of pressure chambers and said narrowed portion includes a plurality of narrowed portions.

41. The ink-jet print head according to claim 40, wherein said first manifold plate includes first through-holes longitudinally staggered in two rows.

42. The ink-jet print head according to claim 41, wherein said second manifold plate includes second through-holes longitudinally staggered in two rows and communicating with said first through-holes.

43. The ink-jet print head according to claim 42, wherein said nozzle includes a plurality of nozzles communicating with said first through-holes and said second through-holes.

44. The ink-jet print head according to claim 43, wherein said spacer plate includes first ink supply ports.

45. The ink-jet print head according to claim 44, wherein said base plate includes second ink supply ports.

46. The ink-jet print head according to claim 45, wherein each of the pressure chambers includes a narrow end portion and another end portion.

47. The ink-jet print head according to claim 46, wherein said narrow end portions communicate with said first through-holes and said second through-holes.

48. The ink-jet print head according to claim 47, wherein said pressure chambers are connected via said narrowed portions to a plurality of another end portions which communicate via said first ink chamber and said second ink chamber with said first and second ink supply ports of said base plate and said spacer plate.

* * * * *